US012140129B2

(12) United States Patent
Takahashi

(10) Patent No.: US 12,140,129 B2
(45) Date of Patent: Nov. 12, 2024

(54) CRYOPUMP

(71) Applicant: SUMITOMO HEAVY INDUSTRIES, LTD., Tokyo (JP)

(72) Inventor: Kakeru Takahashi, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 732 days.

(21) Appl. No.: 17/193,696

(22) Filed: Mar. 5, 2021

(65) Prior Publication Data

US 2021/0190058 A1 Jun. 24, 2021

Related U.S. Application Data

(63) Continuation of application No. PCT/JP2019/030303, filed on Aug. 1, 2019.

(30) Foreign Application Priority Data

Sep. 6, 2018 (JP) ..... 2018-167178

(51) Int. Cl.
*F04B 39/06* (2006.01)
*F04B 37/08* (2006.01)

(52) U.S. Cl.
CPC ..... *F04B 37/08* (2013.01); *F04B 39/064* (2013.01)

(58) Field of Classification Search
CPC ..... F04B 37/08; F04B 39/064
See application file for complete search history.

(56) References Cited

U.S. PATENT DOCUMENTS 3,282,058 A * 11/1966 Venema ..... F25B 9/14 62/100
4,736,591 A 4/1988 Amos et al.
5,228,299 A 7/1993 Harrington et al.
5,231,840 A 8/1993 Yagi et al.
5,400,604 A * 3/1995 Hafner ..... F04B 37/08 62/55.5
5,548,964 A * 8/1996 Jinbo ..... F04B 37/08 62/55.5
6,122,920 A 9/2000 Hill et al.
(Continued)

FOREIGN PATENT DOCUMENTS

JP S61169681 A * 7/1986
JP H05-065874 A 3/1993
(Continued)

OTHER PUBLICATIONS

Miura et al., Cryopump, Mar. 8, 2012, JP2012047120A, Whole Document (Year: 2012).*
(Continued)

*Primary Examiner* — Larry L Furdge
(74) *Attorney, Agent, or Firm* — Michael Best & Friedrich LLP

(57) ABSTRACT

A cryopump includes: a cryopump housing having a cryopump intake port; a radiation shield that is disposed inside the cryopump housing in a non-contact manner with the cryopump housing and is cooled to a shield cooling temperature; and a heat shielding dummy panel that is disposed at the cryopump intake port and mounted to the radiation shield through a thermal resistance member such that a dummy panel temperature becomes higher than the shield cooling temperature.

16 Claims, 7 Drawing Sheets

(56) References Cited

U.S. PATENT DOCUMENTS

| | | | | |
|---|---|---|---|---|
| 9,046,091 | B2 | 6/2015 | Tanaka | |
| 11,644,024 | B2 | 5/2023 | Takahashi | |
| 2007/0295599 | A1* | 12/2007 | Tsuyuki | C23C 14/34 204/192.1 |
| 2013/0061609 | A1 | 3/2013 | Fukuda | |
| 2016/0097380 | A1* | 4/2016 | Oikawa | F04B 37/085 62/55.5 |
| 2016/0146200 | A1* | 5/2016 | Syssoev | F04B 37/08 62/55.5 |
| 2017/0045043 | A1* | 2/2017 | Yatsu | F25D 19/00 |

FOREIGN PATENT DOCUMENTS

| | | | | |
|---|---|---|---|---|
| JP | 2008223538 | A | * | 9/2008 |
| JP | 2010-084702 | A | | 4/2010 |
| JP | 2012047120 | A | * | 3/2012 |
| JP | 2012-237263 | A | | 12/2012 |
| JP | 2018-127927 | A | | 8/2018 |

OTHER PUBLICATIONS

Suzuki et al., Complex Cryopump, Jul. 31, 1986, JPS61169681A, Whole Document (Year: 1986).*

Mochizuki et al., Cryopump, Sep. 25, 2008, JP2008223538A, Whole Document (Year: 2008).*

* cited by examiner

CRYOPUMP

RELATED APPLICATIONS

The contents of Japanese Patent Application No. 2018-167178, and of International Patent Application No. PCT/JP2019/030303, on the basis of each of which priority benefits are claimed in an accompanying application data sheet, are in their entirety incorporated herein by reference.

BACKGROUND

Technical Field

Certain embodiments of the present invention relate to a cryopump.

Description of Related Art

A cryopump is a vacuum pump which captures gas molecules on a cryopanel cooled to a cryogenic temperature by condensation or adsorption to pump the gas molecules. The cryopump is generally used to realize a clean vacuum environment which is required for a semiconductor circuit manufacturing process or the like.

SUMMARY

According to an embodiment of the present invention, there is provided a cryopump including: a cryopump housing having a cryopump intake port; a radiation shield that is disposed inside the cryopump housing in a non-contact manner with the cryopump housing and is cooled to a shield cooling temperature; and a heat shielding dummy panel that is disposed at the cryopump intake port and mounted to the radiation shield through a thermal resistance member such that a dummy panel temperature becomes higher than the shield cooling temperature.

According to another embodiment of the present invention, there is provided a cryopump including: a cryopump housing having a cryopump intake port; a radiation shield that is disposed inside the cryopump housing in a non-contact manner with the cryopump housing and is cooled to a shield cooling temperature; and a heat shielding dummy panel that is disposed at the cryopump intake port and thermally coupled to the cryopump housing such that a dummy panel temperature becomes higher than the shield cooling temperature.

DETAILED DESCRIPTION

Figure 1:
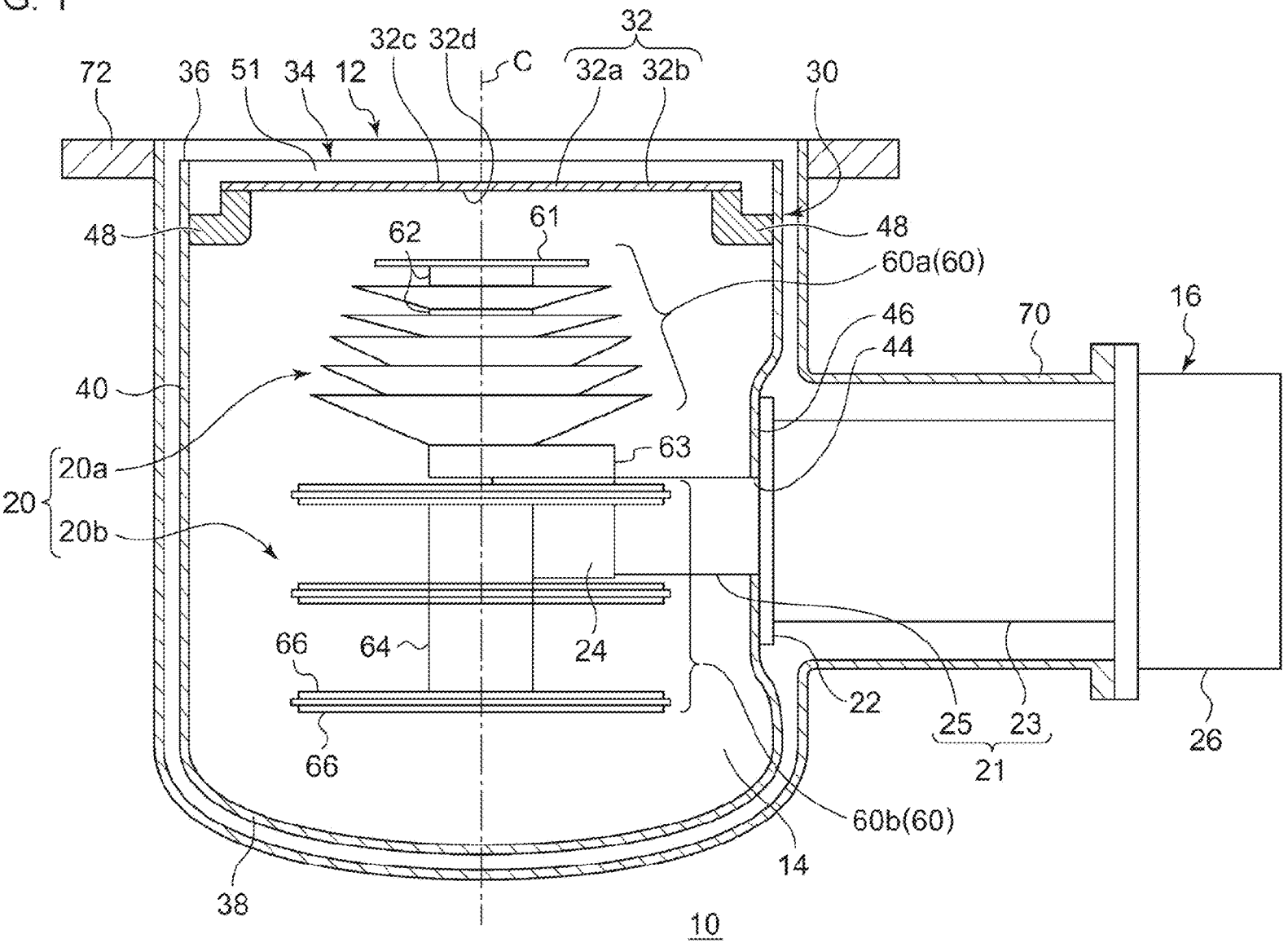
FIG. 1 is a diagram schematically showing a cryopump according to a certain embodiment.

A cryopanel that is cooled to a cryogenic temperature of, for example, about 100 K is disposed at an intake port of the cryopump. In the design of a cryopump of the related art, it is thought that such an intake port cryopanel is essential. However, the inventor of the present invention doubted such a common view and newly found that a cryopump having a different design could also be realized.

It is desirable to provide a cryopump with a new and alternative design.

Any combination of the constituent elements described above, or replacement of constituent elements or expressions of the present invention with each other between methods, apparatuses, systems, or the like is also valid as an aspect of the present invention.

Hereinafter, modes for carrying out the present invention will be described in detail with reference to the drawings. In the description and the drawings, identical or equivalent constituent elements, members, and processing are denoted by the same reference numerals, and overlapping description is omitted appropriately. The scales or shapes of the respective parts shown in the drawings are set for convenience in order to facilitate description and are not interpreted to a limited extent unless otherwise specified. Embodiments are exemplification and do not limit the scope of the present invention. All features described in the embodiments or combinations thereof are not necessarily essential to the invention.

Figure 2:
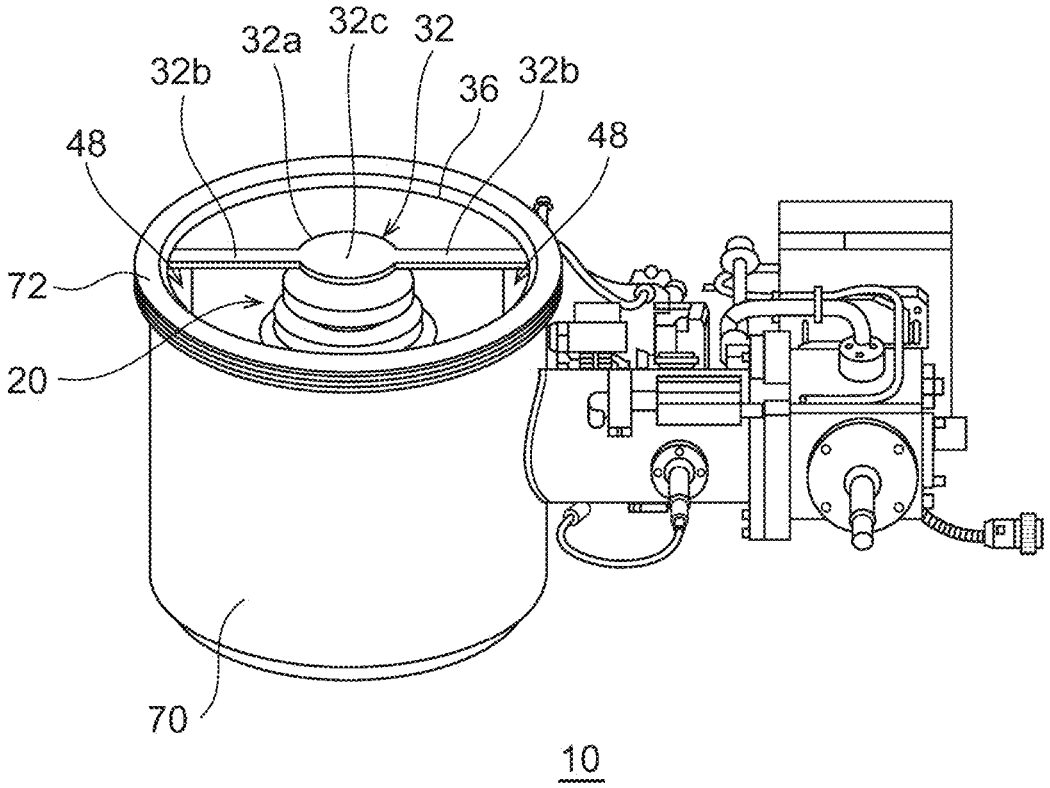
FIG. 2 is a schematic perspective view of the cryopump shown in FIG. 1.

FIG. 1 schematically shows a cryopump 10 according to a certain embodiment. FIG. 2 is a schematic perspective view of the cryopump 10 shown in FIG. 1.

The cryopump 10 is mounted to a vacuum chamber of, for example, an ion implanter, a sputtering apparatus, a vapor deposition apparatus, or other vacuum process equipment and is used to increase the degree of vacuum in the interior of the vacuum chamber to a level which is required for a desired vacuum process. The cryopump 10 has a cryopump intake port (hereinafter, also simply referred to as an "intake port") 12 for receiving a gas to be pumped, from the vacuum chamber. The gas enters an internal space 14 of the cryopump 10 through the intake port 12.

In the following, there is a case where the terms "axial direction" and "radial direction" are used in order to express the positional relationship between constituent elements of the cryopump 10 in an easily understandable manner. The axial direction of the cryopump 10 represents a direction passing through the intake port 12 (that is, a direction along a central axis C in the drawing), and the radial direction represents a direction along the intake port 12 (a first direction in the plane perpendicular to the central axis C). For convenience, with respect to the axial direction, there is a case where the side relatively close to the intake port 12 is referred to as an "upper side" and the side relatively distant from the intake port 12 is referred to as a "lower side". That is, there is a case where the side relatively distant from the bottom of the cryopump 10 is referred to as an "upper side" and the side relatively close to the bottom of the cryopump 10 is referred to as a "lower side". With respect to the radial direction, there is a case where the side close to the center (in the drawing, the central axis C) of the intake port 12 is referred to as an "inner side" and the side close to the peripheral edge of the intake port 12 is referred to as an "outer side". Such expressions are not related to the disposition when the cryopump 10 is mounted to the vacuum chamber. For example, the cryopump 10 may be mounted to the vacuum chamber with the intake port 12 facing downward in the vertical direction.

Further, there is a case where a direction surrounding the axial direction is referred to as a "circumferential direction". The circumferential direction is a second direction along the intake port 12 (a second direction in the plane perpendicular to the central axis C) and is a tangential direction orthogonal to the radial direction.

The cryopump 10 includes a cryocooler 16, a radiation shield 30, a second-stage cryopanel assembly 20, and a cryopump housing 70. The radiation shield 30 may be referred to as a first-stage cryopanel, a high-temperature cryopanel part, or a 100 K part. The second-stage cryopanel assembly 20 may be referred to as a low-temperature cryopanel part or a 10 K part.

The cryocooler 16 is a cryocooler such as a Gifford McMahon type cryocooler (a so-called GM cryocooler), for example. The cryocooler 16 is a two-stage cryocooler. Therefore, the cryocooler 16 includes a first cooling stage 22 and a second cooling stage 24. The cryocooler 16 is configured to cool the first cooling stage 22 to a first cooling temperature and cool the second cooling stage 24 to a second cooling temperature. The second cooling temperature is lower than the first cooling temperature. For example, the first cooling stage 22 is cooled to a temperature in a range of about 65 K to 120 K, preferably, in a range of 80 K to 100 K, and the second cooling stage 24 is cooled to a temperature in a range of about 10 K to 20 K. The first cooling stage 22 and the second cooling stage 24 may be referred to as a high-temperature cooling stage and a low-temperature cooling stage, respectively.

Further, the cryocooler 16 includes a cryocooler structure part 21 that structurally supports the second cooling stage 24 on the first cooling stage 22 and structurally supports the first cooling stage 22 on a room temperature part 26 of the cryocooler 16. Therefore, the cryocooler structure part 21 includes a first cylinder 23 and a second cylinder 25 that extend coaxially along the radial direction. The first cylinder 23 connects the room temperature part 26 of the cryocooler 16 to the first cooling stage 22. The second cylinder 25 connects the first cooling stage 22 to the second cooling stage 24. The room temperature part 26, the first cylinder 23, the first cooling stage 22, the second cylinder 25, and the second cooling stage 24 are linearly arranged in this order.

A first displacer and a second displacer (not shown) are reciprocally disposed in the interiors of the first cylinder 23 and the second cylinder 25, respectively. A first regenerator and a second regenerator (not shown) are respectively incorporated into the first displacer and the second displacer. Further, the room temperature part 26 has a drive mechanism (not shown) for reciprocating the first displacer and the second displacer. The drive mechanism includes a flow path switching mechanism that switches a flow path of a working gas (for example, helium) so as to periodically repeat the supply and discharge of the working gas to and from the interior of the cryocooler 16.

The cryocooler 16 is connected to a compressor (not shown) for the working gas. The cryocooler 16 cools the first cooling stage 22 and the second cooling stage 24 by expanding the working gas pressurized by the compressor in the interior thereof. The expanded working gas is recovered to the compressor and pressurized again. The cryocooler 16 generates cold by repeating a thermodynamic cycle (for example, a refrigeration cycle such as a GM cycle) including the supply and discharge of the working gas and the reciprocation of the first displacer and the second displacer in synchronization with the supply and discharge of the working gas.

The cryopump 10 which is shown in the drawing is a so-called horizontal cryopump. The horizontal cryopump is generally a cryopump in which the cryocooler 16 is disposed so as to intersect (usually, be orthogonal to) the central axis C of the cryopump 10.

The radiation shield 30 surrounds the second-stage cryopanel assembly 20. The radiation shield 30 provides a cryogenic surface for protecting the second-stage cryopanel assembly 20 from a radiant heat outside the cryopump 10 or from the cryopump housing 70. The radiation shield 30 is thermally coupled to the first cooling stage 22.

Accordingly, the radiation shield 30 is cooled to the first cooling temperature. The radiation shield 30 has a gap between itself and the second-stage cryopanel assembly 20, and the radiation shield 30 is not in contact with the second-stage cryopanel assembly 20. The radiation shield 30 is also not in contact with the cryopump housing 70.

The radiation shield 30 is provided to protect the second-stage cryopanel assembly 20 from the radiant heat of the cryopump housing 70. The radiation shield 30 extends in a tubular shape (for example, a cylindrical shape) in the axial direction from the intake port 12. The radiation shield 30 is located between the cryopump housing 70 and the second-stage cryopanel assembly 20 and surrounds the second-stage cryopanel assembly 20. The radiation shield 30 has a shield main opening 34 for receiving gas from the outside of the cryopump 10 into the internal space 14. The shield main opening 34 is located at the intake port 12.

The radiation shield 30 is formed of a high heat conductive metal material such as copper (for example, pure copper), for example. Further, the radiation shield 30 may have a metal plating layer containing, for example, nickel and formed on the surface thereof, in order to improve corrosion resistance, as necessary.

The radiation shield 30 is provided with a shield front end 36 defining the shield main opening 34, a shield bottom portion 38 which is located on the side opposite to the shield main opening 34, and a shield side portion 40 connecting the shield front end 36 to the shield bottom portion 38. The shield side portion 40 extends in the axial direction from the shield front end 36 to the side opposite to the shield main opening 34, and extends so as to surround the second cooling stage 24 in the circumferential direction.

The shield side portion 40 has a shield side portion opening 44 into which the cryocooler structure part 21 is inserted. The second cooling stage 24 and the second cylinder 25 are inserted into the radiation shield 30 from outside the radiation shield 30 through the shield side portion opening 44. The shield side portion opening 44 is a mounting hole formed in the shield side portion 40 and is, for example, circular. The first cooling stage 22 is disposed outside the radiation shield 30.

The shield side portion 40 is provided with a mounting seat 46 for the cryocooler 16. The mounting seat 46 is a flat portion for mounting the first cooling stage 22 to the radiation shield 30, and is slightly depressed when viewed from outside the radiation shield 30. The mounting seat 46 forms the outer periphery of the shield side portion opening 44. The first cooling stage 22 is mounted to the mounting seat 46, whereby the radiation shield 30 is thermally coupled to the first cooling stage 22.

Instead of directly mounting the radiation shield 30 to the first cooling stage 22 in this manner, in an embodiment, the radiation shield 30 may be thermally coupled to the first cooling stage 22 through an additional heat transfer member. The heat transfer member may be, for example, a hollow short cylinder having flanges at both ends. The heat transfer member may be fixed to the mounting seat 46 by the flange at one end and fixed to the first cooling stage 22 by the flange at the other end. The heat transfer member may extend from the first cooling stage 22 to the radiation shield 30 to surround the cryocooler structure part 21. The shield side portion 40 may include such a heat transfer member.

In the illustrated embodiment, the radiation shield 30 is configured in an integral tubular shape. Instead, the radiation shield 30 may be configured to have a tubular shape as a whole by a plurality of parts. The plurality of parts may be disposed with a gap therebetween. For example, the radiation shield 30 may be divided into two parts in the axial direction.

The cryopump 10 includes a heat shielding dummy panel 32 disposed at the intake port 12. The heat shielding dummy panel 32 is mounted to the radiation shield 30 through a thermal resistance member 48 such that a dummy panel temperature becomes higher than a shield cooling temperature (for example, the first cooling temperature described above).

In other words, the heat shielding dummy panel 32 is disposed at the intake port 12 so as to avoid cooling by the cryocooler 16 as much as possible. The heat shielding dummy panel 32 is not a "cryopanel" intended to be cooled to a cryogenic temperature. Accordingly, the heat shielding dummy panel 32 may be designed such that the dummy panel temperature exceeds 0° C. during the operation of the cryopump 10. However, depending on the design of the thermal resistance member 48 and/or a method of mounting the heat shielding dummy panel 32 to the radiation shield 30, the dummy panel temperature may fall below 0° C. during the operation of the cryopump 10. However, even in that case, the dummy panel temperature is maintained at a temperature higher than the shield cooling temperature.

The heat shielding dummy panel 32 is provided at the intake port 12 (or the shield main opening 34, the same applies hereinafter) in order to protect the second-stage cryopanel assembly 20 from a radiant heat from a heat source outside the cryopump 10 (for example, a heat source in the vacuum chamber to which the cryopump 10 is mounted). Since the heat shielding dummy panel 32 is not almost or entirely cooled by the cryocooler 16, it does not have a function of condensing a gas (for example, a function of pumping a type 1 gas such as water vapor).

The heat shielding dummy panel 32 is disposed at a location corresponding to the second-stage cryopanel assembly 20 at the intake port 12, for example, directly above the second-stage cryopanel assembly 20. The heat shielding dummy panel 32 occupies the central portion of the opening area of the intake port 12, and forms an annular (for example, circular ring-shaped) open area 51 between itself and the radiation shield 30.

The heat shielding dummy panel 32 is disposed at the central portion of the intake port 12. The center of the heat shielding dummy panel 32 is located on the central axis C. However, the center of the heat shielding dummy panel 32 may be located somewhat off from the central axis C, and even in that case, the heat shielding dummy panel 32 can be regarded as being located at the central portion of the intake port 12. The heat shielding dummy panel 32 is disposed perpendicular to the central axis C.

Further, with respect to the axial direction, the heat shielding dummy panel 32, may be disposed slightly above the shield front end 36. In that case, since the heat shielding dummy panel 32 can be disposed farther from the second-stage cryopanel assembly 20, the thermal action (that is, cooling) on the heat shielding dummy panel 32 from the second-stage cryopanel assembly 20 can be reduced. Alternatively, the heat shielding dummy panel 32 may be disposed at substantially the same height as the shield front end 36 in the axial direction, or slightly below the shield front end 36 in the axial direction.

The heat shielding dummy panel 32 is formed of a single flat plate. The heat shielding dummy panel 32 has a dummy panel central portion 32*a* and a dummy panel mounting portion 32*b* extending radially outward from the dummy panel central portion 32*a*. The shape of the dummy panel central portion 32*a* when viewed in the axial direction is, for example, a disk shape. The diameter of the dummy panel central portion 32*a* is relatively small and is smaller than the diameter of the second-stage cryopanel assembly 20, for example. The dummy panel central portion 32*a* may occupy at most ⅓ or at most ¼ of the opening area of the intake port 12. In this way, the open area 51 may occupy at least ⅔ or at least ¾ of the opening area of the intake port 12.

The dummy panel central portion 32*a* is mounted to the thermal resistance member 48 through the dummy panel mounting portion 32*b*. As shown in FIGS. 1 and 2, the dummy panel mounting portion 32*b* is linearly bridged to the thermal resistance member 48 along the diameter of the shield main opening 34. Further, the dummy panel mounting portion 32*b* divides the open area 51 in the circumferential direction. The open area 51 is composed of a plurality of (for example, two) arc-shaped areas. The dummy panel mounting portions 32*b* are provided on both sides of the dummy panel central portion 32*a*. However, the dummy panel mounting portions 32*b* may extend in four directions from the dummy panel central portion 32*a* so as to form a cross shape when viewed in the axial direction, or may have other shapes. Here, the dummy panel central portion 32*a* and the dummy panel mounting portion 32*b* of the heat shielding dummy panel 32 are integrally formed. However, the dummy panel central portion 32*a* and the dummy panel mounting portion 32*b* may be provided as separate members and joined to each other.

Since the heat shielding dummy panel 32 is not a cryopanel, it does not require as high thermal conductivity as the cryopanel. Therefore, the heat shielding dummy panel 32 does not need to be formed of high thermal conductivity metal such as copper, and may be formed of, for example, stainless steel or other easily available metal material. Alternatively, the heat shielding dummy panel 32 may be formed of a metal material, a resin material (for example, a fluororesin material such as polytetrafluoroethylene), or any other material as long as it is suitable for use in a vacuum environment. Further, a part (for example, the dummy panel central portion 32*a*) of the heat shielding dummy panel 32 may be formed of a metal material, and the other part (for example, the dummy panel mounting portion 32*b*) of the heat shielding dummy panel 32 may be formed of a resin material.

The thermal resistance member 48 is formed of a material having a lower thermal conductivity than the material (for example, pure copper, as described above) of the radiation shield 30, or a heat insulating material. In a case where it is considered that it is important to reduce the heat conduction between the radiation shield 30 and the heat shielding dummy panel 32, the thermal resistance member 48 may be formed of, for example, a fluororesin material such as polytetrafluoroethylene, or other resin material. In a case where it is considered that it is important to reduce the thermal shrinkage of the thermal resistance member 48 and more reliably fix the heat shielding dummy panel 32 (for example, to prevent loosening of bolts), the thermal resistance member 48 may be formed of a metal material such as stainless steel, for example.

The thermal resistance member 48 is fixed to the inner peripheral surface of the shield front end 36 to correspond to the dummy panel mounting portion 32*b* of the heat shielding dummy panel 32. As shown in the drawings, in a case where two dummy panel mounting portions 32*b* are provided on both sides of the dummy panel central portion 32*a*, two thermal resistance members 48 are provided. The thermal resistance member 48 is fixed to the shield front end 36 by a fastening member such as a bolt or other appropriate method. The tip part of the dummy panel mounting portion 32*b* is fixed to the thermal resistance member 48 by a fastening member such as a bolt or other appropriate method. The smaller the contact area between the dummy panel mounting portion 32*b* and the thermal resistance member 48 and/or the cross-sectional area of the thermal resistance member 48 and/or the contact area between the thermal resistance member 48 and the shield front end 36, the smaller the heat conduction between the radiation shield 30 and the heat shielding dummy panel 32 can become.

In this way, the heat shielding dummy panel 32 is thermally insulated from the radiation shield 30 or is connected to the radiation shield 30 through a high thermal resistance. The heat shielding dummy panel 32 is disposed at the intake port 12 so as to be in non-contact with the shield front end 36 and other portions of the radiation shield 30. Further, the heat shielding dummy panel 32 is close to, but not in contact with, the second-stage cryopanel assembly 20.

The heat shielding dummy panel 32 includes a dummy panel outer surface 32*c* facing the outside of the cryopump 10, and a dummy panel inner surface 32*d* facing the inside of the cryopump 10. The dummy panel outer surface 32*c* can also be referred to as a dummy panel upper surface, and the dummy panel inner surface 32*d* can also be referred to as a dummy panel lower surface.

An emissivity of the dummy panel outer surface 32*c* may be higher than an emissivity of the dummy panel inner surface 32*d*. That is, reflectance of the dummy panel outer surface 32*c* may be lower than reflectance of the dummy panel inner surface 32*d*. Therefore, the dummy panel outer surface 32*c* may have a black surface. The black surface may be formed, for example, by black painting, black plating, or other blackening treatment. Alternatively, the dummy panel outer surface 32*c* may have a rough surface. The dummy panel outer surface 32*c* may be subjected to, for example, sandblasting or other roughening treatment. The dummy panel inner surface 32*d* may have a mirror surface. The dummy panel inner surface 32*d* may be subjected to polishing or other mirror surface treatment.

As a first example, a case where both the dummy panel outer surface 32*c* and the dummy panel inner surface 32*d* are black is considered. In this case, both the emissivity of the dummy panel outer surface 32*c* and the emissivity of the dummy panel inner surface 32*d* are regarded as being 1. Heat input to the heat shielding dummy panel 32 among the heat input to the cryopump 10 is defined as Q [W]. When the heat shielding dummy panel 32 receives the heat input Q, a radiant heat Wo [W] that is radiated by the dummy panel outer surface 32*c* is $Wo=(1/(1+1))Q=Q/2$, and a radiant heat Wi [W] that is radiated by the dummy panel inner surface 32*d* is $Wi=(1/(1+1))Q=Q/2$. That is, the outward radiant heat Wo and the inward radiant heat Wi are equal. The radiant heat Wo is discharged from the dummy panel outer surface 32*c* to the outside of the cryopump 10. The radiant heat Wi goes from the dummy panel inner surface 32*d* toward the inside of the cryopump 10, that is, the radiation shield 30 and the second-stage cryopanel assembly 20. However, it is cooled by the cryocooler 16 and discharged from the cryopump 10.

As a second example, a case where the dummy panel outer surface 32*c* is black and the dummy panel inner surface 32*d* is a mirror surface is considered. The emissivity of the dummy panel outer surface 32*c* is regarded as being 1. The emissivity of the dummy panel inner surface 32*d* is assumed to be 0.1, for example. In this case, when the heat shielding dummy panel 32 receives the heat input Q, the radiant heat Wo [W] that is radiated by the dummy panel outer surface 32*c* is $Wo=(1/(1+0.1))Q=(10/11)Q$, and the radiant heat Wi [W] that is radiated by the dummy panel inner surface 32*d* is $Wi=(0.1/(1+0.1))Q=(1/11)Q$.

Therefore, by making the emissivity of the dummy panel outer surface 32*c* higher than the emissivity of the dummy panel inner surface 32*d*, it is possible to increase the amount of heat that is discharged from the heat shielding dummy panel 32 toward the outside of the cryopump 10. At the same time, the amount of heat that goes from the heat shielding dummy panel 32 toward the inside of the cryopump 10 and is discharged from the cryopump 10 by the cryocooler 16 is reduced. Therefore, the power consumption of the cryocooler 16 can be reduced.

The second-stage cryopanel assembly 20 is provided at the central portion of the internal space 14 of the cryopump 10. The second-stage cryopanel assembly 20 includes an upper structure 20*a* and a lower structure 20*b*. The second-stage cryopanel assembly 20 includes a plurality of adsorption cryopanels 60 arranged in the axial direction. The plurality of adsorption cryopanels 60 are arranged at intervals in the axial direction.

The upper structure 20*a* of the second-stage cryopanel assembly 20 includes a plurality of upper cryopanels 60*a* and a plurality of heat transfer bodies (also referred to as heat transfer spacers) 62. The plurality of upper cryopanels 60*a* are disposed between the heat shielding dummy panel 32 and the second cooling stage 24 in the axial direction. The plurality of heat transfer bodies 62 are arranged in a columnar shape in the axial direction. The plurality of upper cryopanels 60*a* and the plurality of heat transfer bodies 62 are alternately stacked in the axial direction between the intake port 12 and the second cooling stage 24. The centers of the upper cryopanel 60*a* and the heat transfer body 62 are located together on the central axis C. In this way, the upper structure 20*a* is disposed above the second cooling stage 24 in the axial direction. The upper structure 20*a* is fixed to the second cooling stage 24 through a heat transfer block 63 formed of a high heat conductive metal material such as copper (for example, pure copper), and is thermally coupled to the second cooling stage 24. Therefore, the upper structure 20*a* is cooled to the second cooling temperature.

The lower structure 20*b* of the second-stage cryopanel assembly 20 includes a plurality of lower cryopanels 60*b* and a second-stage cryopanel mounting member 64. The plurality of lower cryopanels 60*b* are disposed between the second cooling stage 24 and the shield bottom portion 38 in the axial direction. The second-stage cryopanel mounting member 64 extends downward in the axial direction from the second cooling stage 24. The plurality of lower cryopanels 60*b* are mounted to the second cooling stage 24 through the second-stage cryopanel mounting members 64. In this way, the lower structure 20*b* is thermally coupled to the second cooling stage 24 and is cooled to the second cooling temperature.

In the second-stage cryopanel assembly 20, an adsorption area 66 is formed on at least a part of the surface. The adsorption area 66 is provided, for capturing a non-condensable gas (for example, hydrogen) by adsorption. The adsorption area 66 is formed for example, by bonding an adsorbent (for example, activated carbon) to the surface of the cryopanel.

As an example, one or a plurality of upper cryopanels 60*a* that are closest to the heat shielding dummy panel 32 in the axial direction, among the plurality of upper cryopanels 60*a*, are flat plates (for example, disk-shaped) and are disposed perpendicular to the central axis C. The remaining upper cryopanels 60*a* have an inverted truncated cone shape, and a circular bottom surface is disposed perpendicular to the central axis C.

The upper cryopanel 60*a* closest to the heat shielding dummy panel 32 (that is, the upper cryopanel 60*a* located directly below the heat shielding dummy panel 32 in the axial direction, also referred to as a top cryopanel 61), among the upper cryopanels 60*a*, has a diameter larger than that of the heat shielding dummy panel 32. However, the diameter of the top cryopanel 61 may be equal to or smaller than the diameter of the heat shielding dummy panel 32. The top cryopanel 61 directly faces the heat shielding dummy panel 32, and no other cryopanel exists between the top cryopanel 61 and the heat shielding dummy panel 32.

The diameters of the plurality of upper cryopanels 60*a* gradually increase toward the lower side in the axial direction. Further, the inverted truncated cone-shaped upper cryopanel 60*a* is disposed in a nested manner. The lower part of the upper cryopanel 60*a* on the higher side enters the inverted truncated conical space in the upper cryopanel 60*a* adjacent thereunder.

Each heat transfer body 62 has a columnar shape. The heat transfer body 62 may have a relatively short columnar shape and may have an axial height smaller than the diameter of the heat transfer body 62. The cryopanel such as the adsorption cryopanel 60 is generally formed of a high heat conductive metal material such as copper (for example, pure copper), and as necessary, the surface thereof is coated with a metal layer such as nickel. In contrast, the heat transfer body 62 may be formed of a material different from that of the cryopanel. The heat transfer body 62 may be formed of a metal material, such as aluminum or an aluminum alloy, for example, having a lower density although it has a lower thermal conductivity than the adsorption cryopanel 60. In this way, both the thermal conductivity and the reduction in weight of the heat transfer body 62 can be achieved to some extent, which is helpful to reduce the cooling time of the second-stage cryopanel assembly 20.

The lower cryopanel 60*b* is a flat plate, for example, in a disk shape. The lower cryopanel 60*b* has a larger diameter than the upper cryopanel 60*a*. However, a cutout portion extending from a portion of the outer periphery to the central portion may be formed in the lower cryopanel 60*b* for mounting the lower cryopanel 60*b* to the second-stage cryopanel mounting member 64.

The specific configuration of the second-stage cryopanel assembly 20 is not limited to the configuration described above. The upper structure 20*a* may have any number of upper cryopanels 60*a*. The upper cryopanel 60*a* may have a flat plate shape, a conical shape, or other shapes. Similarly, the lower structure 20*b* may have any number of lower cryopanels 60*b*. The lower cryopanel 60*b* may have a flat plate shape, a conical shape, or other shapes.

The adsorption area 66 may be formed in a place that is hidden behind the adsorption cryopanel 60 adjacent to the upper side so as not to be seen from the intake port 12. For example, the adsorption area 66 is formed on the entire lower surface of the adsorption cryopanel 60. The adsorption area 66 may be formed on the upper surface of the lower cryopanel 60*b*. Further, although not shown in FIG. 1 for the sake of simplification, the adsorption area 66 is also formed on the lower surface (back surface) of the upper cryopanel 60*a*. As necessary, the adsorption area 66 may be formed on the upper surface of the upper cryopanel 60*a*.

In the adsorption area 66, a large number of activated carbon particles are bonded in an irregular arrangement in a state of being densely arranged on the surface of the adsorption cryopanel 60. The activated carbon particles are molded, for example, in a columnar shape. The shape of the adsorbent may not be a columnar shape and may be, for example, a spherical shape, another molded shape, or an irregular shape. The arrangement of the adsorbents on the panel may be a regular arrangement or an irregular arrangement.

Further, a condensation area for capturing a condensable gas by condensation is formed on at least a part of the surface of the second-stage cryopanel assembly 20. The condensation area is, for example, a section where the adsorbent is missing on the surface of the cryopanel, and the surface of the cryopanel base material, for example, the metal surface is exposed. The upper surface, the outer peripheral portion of the upper surface, or the outer peripheral portion of the lower surface of the adsorption cryopanel 60 (for example, the upper cryopanel 60*a*) may be a condensation area.

Both the upper and lower surfaces of the top cryopanel 61 may be condensation areas. That is, the top cryopanel 61 may not have the adsorption area 66. In this manner, in the second-stage cryopanel assembly 20, the cryopanel which does not have the adsorption area 66 may be referred to as a condensation cryopanel. For example, the upper structure 20*a* may be provided with at least one condensation cryopanel (for example, the top cryopanel 61).

As described above, the second-stage cryopanel assembly 20 has a large number of adsorption cryopanels 60 (that is, the plurality of upper cryopanels 60*a* and lower cryopanels 60*b*), and therefore, it has high pumping performance for a non-condensable gas. For example, the second-stage cryopanel assembly 20 can pumping hydrogen gas at a high pumping speed.

Each of the plurality of adsorption cryopanels 60 includes the adsorption area 66 at a portion which is not visible from the outside from the cryopump 10. Therefore, the second-stage cryopanel assembly 20 is configured such that all or most of the adsorption areas 66 are completely invisible from the outside of the cryopump 10. The cryopump 10 can also be called an adsorbent non-exposure type cryopump.

The cryopump housing 70 is a casing of the cryopump 10, which accommodates the radiation shield 30, the second-stage cryopanel assembly 20, and the cryocooler 16, and is a vacuum container configured to maintain the vacuum tightness of the internal space 14. The cryopump housing 70 includes the radiation shield 30 and the cryocooler structure part 21 in a non-contact manner. The cryopump housing 70 is mounted to the room temperature part 26 of the cryocooler 16.

The intake port 12 is defined by a front end of the cryopump housing 70. The cryopump housing 70 has an intake port flange 72 extending radially outward from the front end thereof. The intake port flange 72 is provided over the entire circumference of the cryopump housing 70. The cryopump 10 is mounted to a vacuum chamber to be evacuated by using the intake port flange 72.

The operation of the cryopump 10 having the above configuration will be described below. When the cryopump 10 is operated, first, the interior of the vacuum chamber is roughed to about 1 Pa with another appropriate roughing pump before the operation. Thereafter, the cryopump 10 is operated. The first cooling stage 22 and the second cooling stage 24 are respectively cooled to the first cooling temperature and the second cooling temperature by the driving of the cryocooler 16. Accordingly, the radiation shield 30 and the second-stage cryopanel assembly 20 thermally coupled to these are also respectively cooled to the first cooling temperature and the second cooling temperature.

A part of the gas that comes flying from the vacuum chamber toward the cryopump 10 enters the internal space 14 from the intake port 12 (for example, the open area 51 around the heat shielding dummy panel 32). The other part of the gas is reflected by the heat shielding dummy panel 32 and does not enter the internal space 14.

As described above, since the heat shielding dummy panel 32 is mounted to the radiation shield 30 through the thermal resistance member 48, the heat shielding dummy panel 32 is thermally insulated from the radiation shield 30 or is connected to the radiation shield 30 through a high thermal resistance. Therefore, the heat shielding dummy panel 32 is maintained at, for example, room temperature or a temperature higher than 0° C. during the operation of the cryopump 10. Since the heat shielding dummy panel 32 is not almost or entirely cooled by the cryocooler 16, almost or all the gas that is in contact with the heat shielding dummy panel 32 does not condense on the heat shielding dummy panel 32.

A gas having a sufficiently low vapor pressure (for example, $10^{-8}$ Pa or less) at the first cooling temperature condenses on the surface of the radiation shield 30. This gas may be referred to as a type 1 gas. The type 1 gas is, for example, water vapor. In this way, the radiation shield 30 can pump the type 1 gas. A gas in which vapor pressure is not sufficiently low at the first cooling temperature is reflected by the radiation shield 30, and a part thereof goes to the second-stage cryopanel assembly 20.

The gas that has entered the internal space 14 is cooled by the second-stage cryopanel assembly 20. The type 1 gas reflected by the radiation shield 30 condenses on the surface of the condensation area of the adsorption cryopanel 60. In addition, a gas having a sufficiently low vapor pressure (for example, $10^{-8}$ Pa or less) at the second cooling temperature condenses on the surface of the condensation area of the adsorption cryopanel 60. This gas may be referred to as a type 2 gas. The type 2 gas is, for example, nitrogen ($N_2$) or argon (Ar). In this way, the second-stage cryopanel assembly 20 can pump the type 2 gas.

A gas in which vapor pressure is not sufficiently low at the second cooling temperature is adsorbed by the adsorption area 66 of the adsorption cryopanel 60. This gas may be referred to as a type 3 gas. The type 3 gas is, for example, hydrogen ($H_2$). In this way, the second-stage cryopanel assembly 20 can pump the type 3 gas. Therefore, the cryopump 10 can pump various gases by condensation or adsorption and can make the degree of vacuum of the vacuum chamber reach a desired level.

According to the cryopump 10 of the embodiment, the heat shielding dummy panel 32 is disposed at the intake port 12. The heat shielding dummy panel 32 is mounted to the radiation shield 30 through the thermal resistance member 48 such that the dummy panel temperature becomes higher than the shield cooling temperature. In this way, the heat shielding dummy panel 32 can provide a function of protecting the second-stage cryopanel assembly 20 from a radiant heat. Unlike a typical cryopump in which a cryopanel that is disposed at an intake port is essential, the cryopump 10 has a new and alternative design.

The thermal resistance member 48 is formed of a material having a lower thermal conductivity than the material of the radiation shield 30, or a heat insulating material. In this way, it is easy to connect the heat shielding dummy panel 32 to the radiation shield 30 through a high thermal resistance, or to thermally insulate the heat shielding dummy panel 32 from the radiation shield 30. As a result, it is possible to make the dummy panel temperature significantly higher than the shield cooling temperature.

Further, by making the emissivity of the dummy panel outer surface 32*c* higher than the emissivity of the dummy panel inner surface 32*d*, it is possible to increase the amount of heat that is discharged from the heat shielding dummy panel 32 toward the outside of the cryopump 10. At the same time, it is possible to reduce the amount of heat that goes from the heat shielding dummy panel 32 toward the inside of the cryopump 10.

The dummy panel temperature exceeds 0° C. Therefore, it is guaranteed that the heat shielding dummy panel 32 does not provide the pumping capacity for the type 1 gas. It is avoided that an ice layer due to the condensation of water covers the surface (for example, the dummy panel outer surface 32*c*) of the heat shielding dummy panel 32. Therefore, it is possible to suppress an increase in reflectance (a decrease in emissivity) that may occur due to the formation of an ice layer, during the operation of the cryopump 10.

Since the heat shielding dummy panel 32 does not need to be cooled, it does not need to be formed of a high thermal conductivity metal such as pure copper as in a cryopanel that is disposed at an intake port in a cryopump of the related art. Further, plating treatment of nickel or the like is also not required. In addition, for the same reason, the heat shielding dummy panel 32 may be thinner than the cryopanel. Therefore, the heat shielding dummy panel 32 can be manufactured by a common processing method using an easily available material such as stainless steel, for example, and is inexpensive.

Further, since the heat shielding dummy panel 32 does not need to be cooled, the power consumption of the cryocooler 16 can be reduced.

In the embodiment described above, the heat shielding dummy panel 32 is mounted to the radiation shield 30 through the thermal resistance member 48. However, the heat shielding dummy panel 32 may be thermally coupled to the cryopump housing 70 such that the dummy panel temperature becomes higher than the shield cooling temperature. Such an embodiment will be described below.

Figure 3:
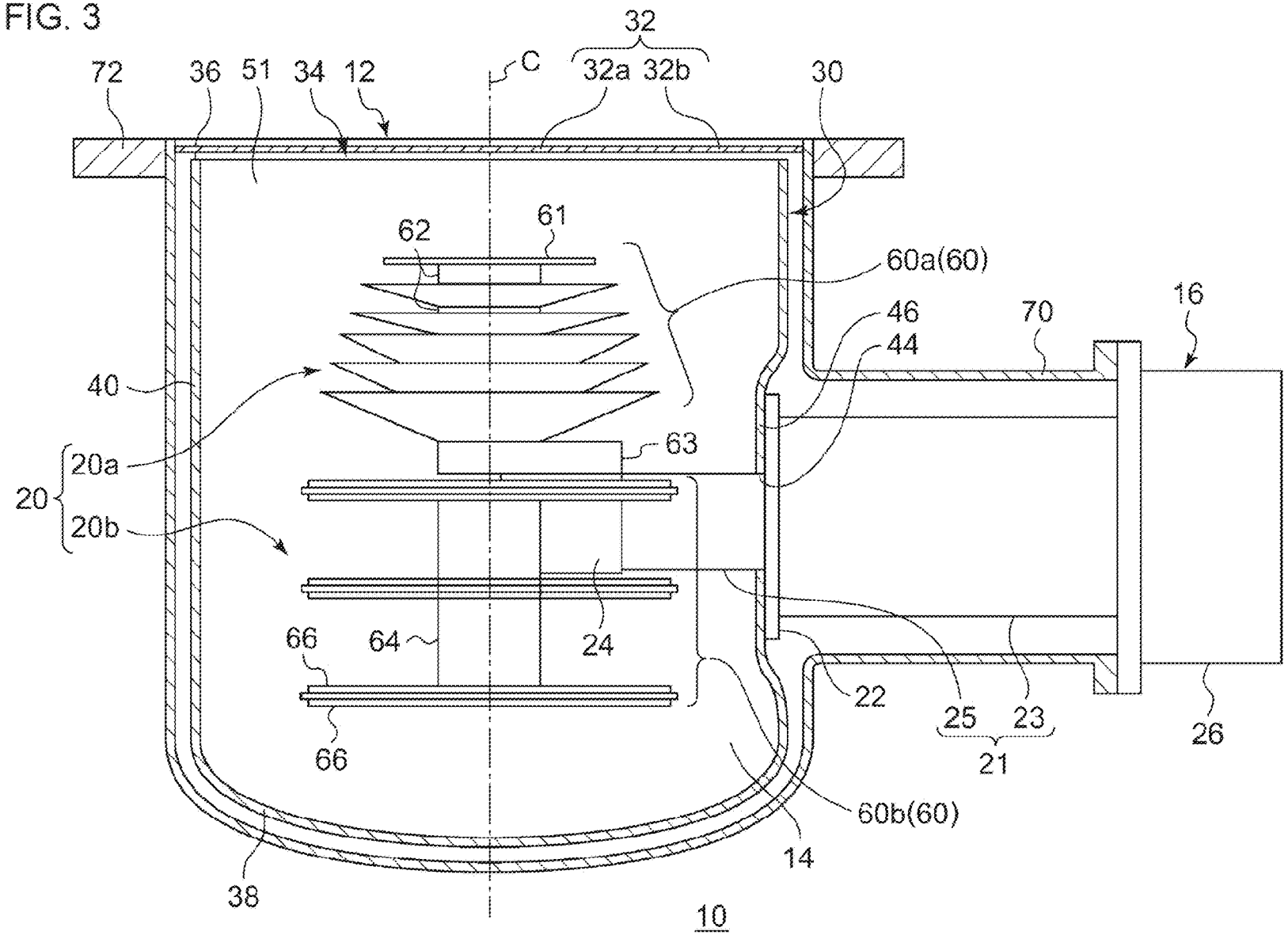
FIG. 3 is a diagram schematically showing a cryopump according to another embodiment.

FIG. 3 schematically shows a cryopump 10 according to another embodiment. As shown in the drawing, the heat shielding dummy panel 32 that is disposed at the intake port 12 is mounted to the intake port flange 72. The heat shielding dummy panel 32 has the dummy panel central portion 32*a* disposed at the central portion of the intake port 12, and the dummy panel mounting portion 32*b* extending radially outward from the dummy panel central portion 32*a*, as in the embodiment shown in FIGS. 1 and 2. The dummy panel mounting portion 32*b* is fixed to the inner periphery of the intake port flange 72 by, for example, a fastening member such as a bolt or other appropriate method.

In this way, the heat shielding dummy panel 32 is directly mounted to the cryopump housing 70 and is thermally coupled to the cryopump housing 70. Therefore, the heat shielding dummy panel 32 has a dummy panel temperature higher than the shield cooling temperature during the operation of the cryopump 10. Therefore, the heat shielding dummy panel 32 can provide a function of protecting the second-stage cryopanel assembly 20 from a radiant heat.

Since the heat shielding dummy panel 32 is thermally coupled to the cryopump housing 70, it can be easily maintained at the dummy panel temperature significantly higher than the shield cooling temperature, for example, a temperature higher than 0° C. (particularly room temperature). Further, since the thermal resistance member 48 as in the embodiment shown in FIGS. 1 and 2 is not required, it is advantageous in that the mounting structure of the heat shielding dummy panel 32 can be simplified.

The heat shielding dummy panel 32 may be mounted to the intake port flange 72 through another member and thermally coupled to the cryopump housing 70. The heat shielding dummy panel 32 may be mounted to a mating flange to which the intake port flange 72 is mounted, or a center ring that is sandwiched between the intake port flange 72 and the mating flange. Such an embodiment will be described below.

Figure 4:
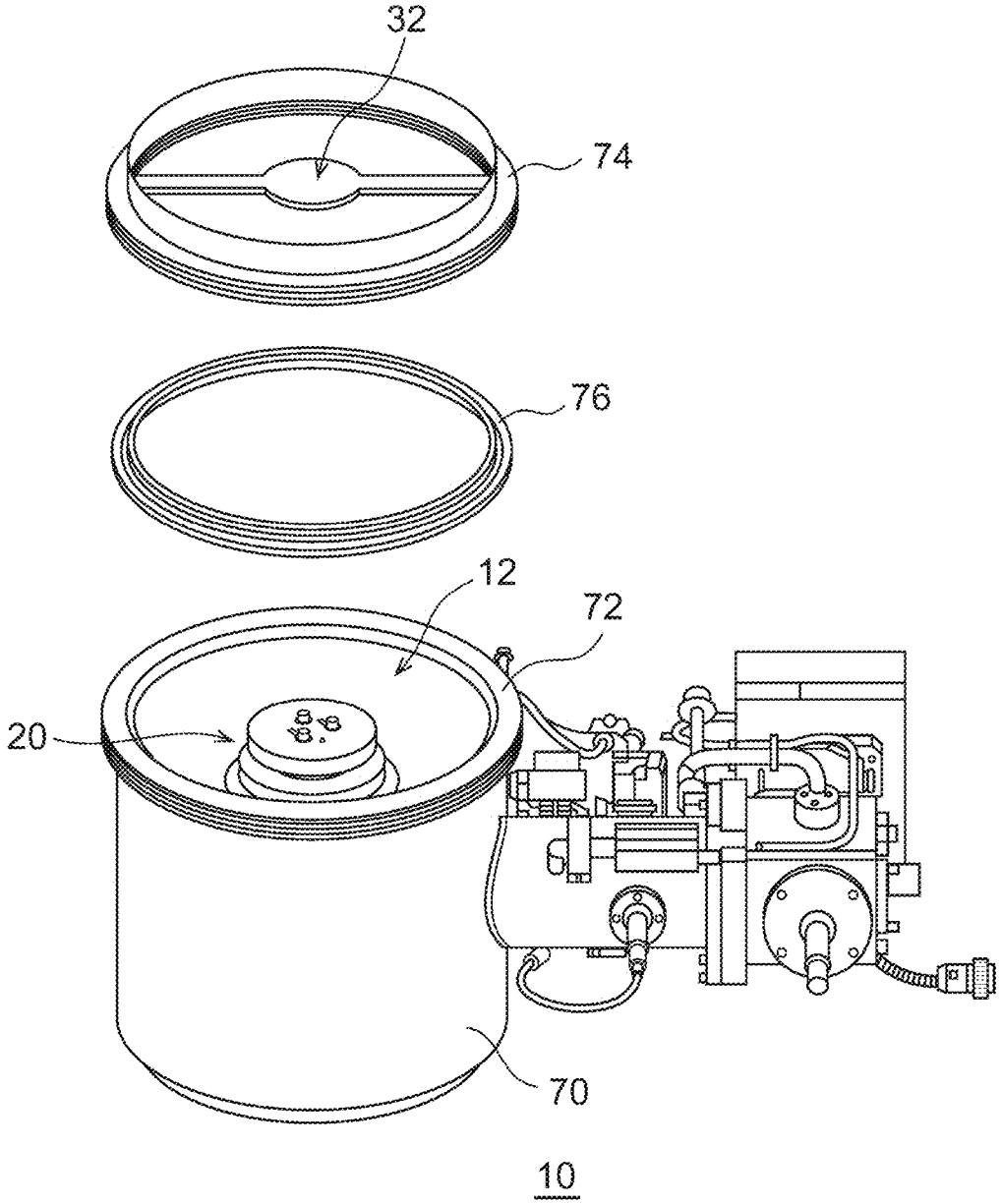
FIG. 4 is a schematic perspective view of a cryopump according to still another embodiment.
Figure 5:
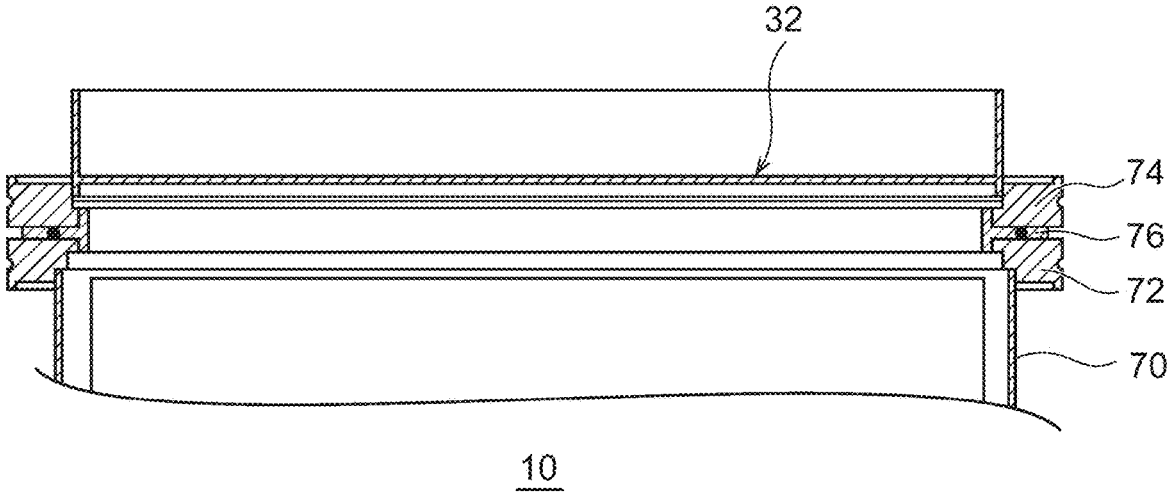
FIG. 5 is a partial sectional view schematically showing a portion of the cryopump shown in FIG. 4.

FIG. 4 is a schematic perspective view of a cryopump 10 according to still another embodiment. FIG. 5 is a partial sectional view schematically showing a portion of the cryopump 10 shown in FIG. 4. FIG. 5 shows a part of the cross section of the cryopump 10 in a plane which includes the central axis of the cryopump, as in FIG. 1, and shows the heat shielding dummy panel 32 disposed at the intake port 12 and members around it.

In the embodiment shown in FIGS. 4 and 5, the heat shielding dummy panel 32 is mounted to a mating flange 74 to which the intake port flange 72 is mounted. The mating flange 74 may be, for example, a vacuum flange of a gate valve to which the cryopump 10 is mounted. The mating flange 74 may be a vacuum flange of the vacuum chamber to which the cryopump 10 is mounted. A center ring 76 is provided between the intake port flange 72 and the mating flange 74. As is known, when the intake port flange 72 is mounted to the mating flange 74, the center ring 76 is sandwiched between the intake port flange 72 and the mating flange 74.

The heat shielding dummy panel 32 is mounted to the intake port flange 72 through the mating flange 74 and is thermally coupled to the cryopump housing 70. Even in this way, the heat shielding dummy panel 32 has a dummy panel temperature, for example, room temperature, higher than the shield cooling temperature during the operation of the cryopump 10. Therefore, similar to the embodiments described above, the heat shielding dummy panel 32 can provide a function of protecting the second-stage cryopanel assembly 20 from a radiant heat.

Figure 6:
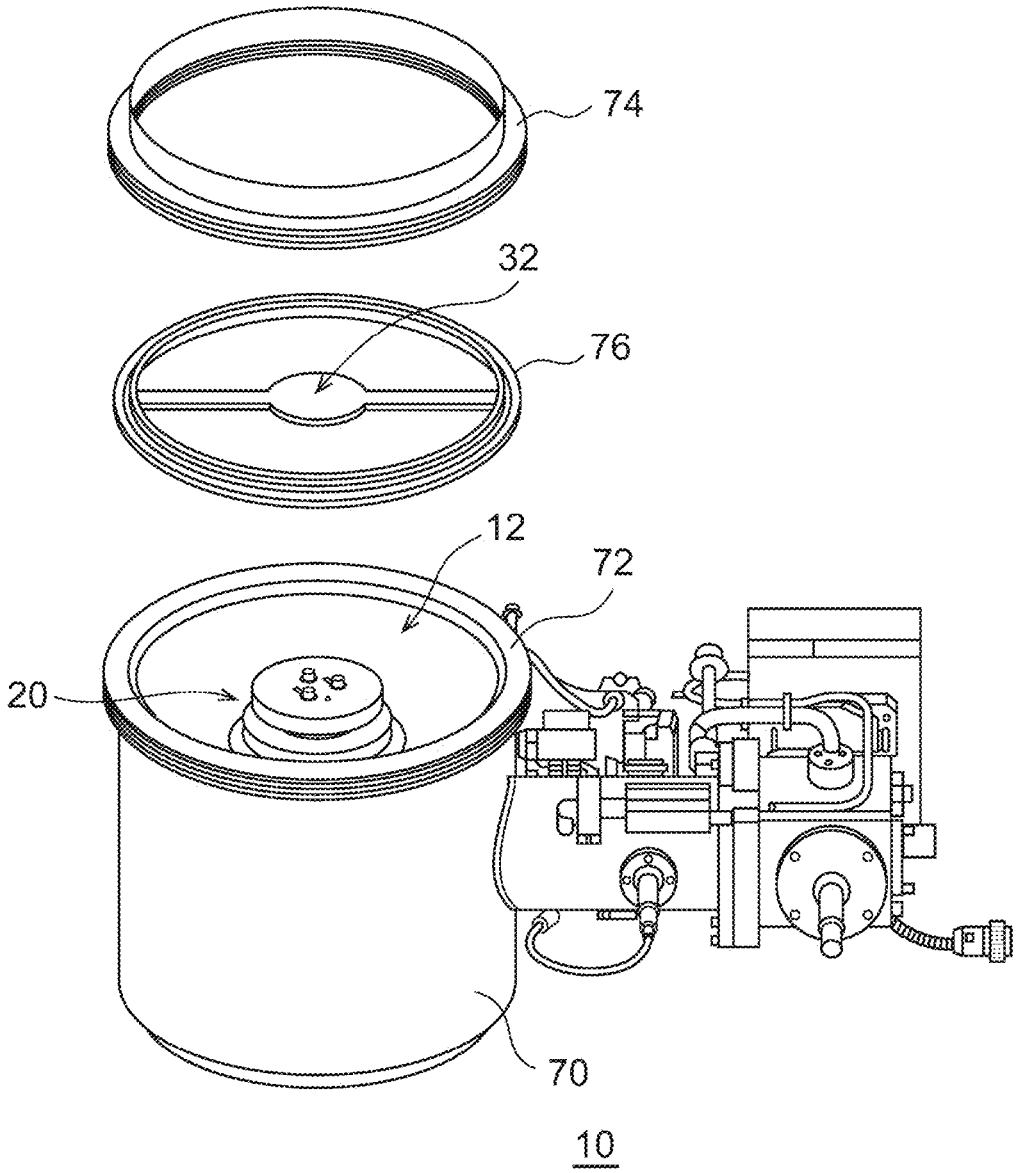
FIG. 6 is a schematic perspective view of a cryopump according to still yet another embodiment.
Figure 7:
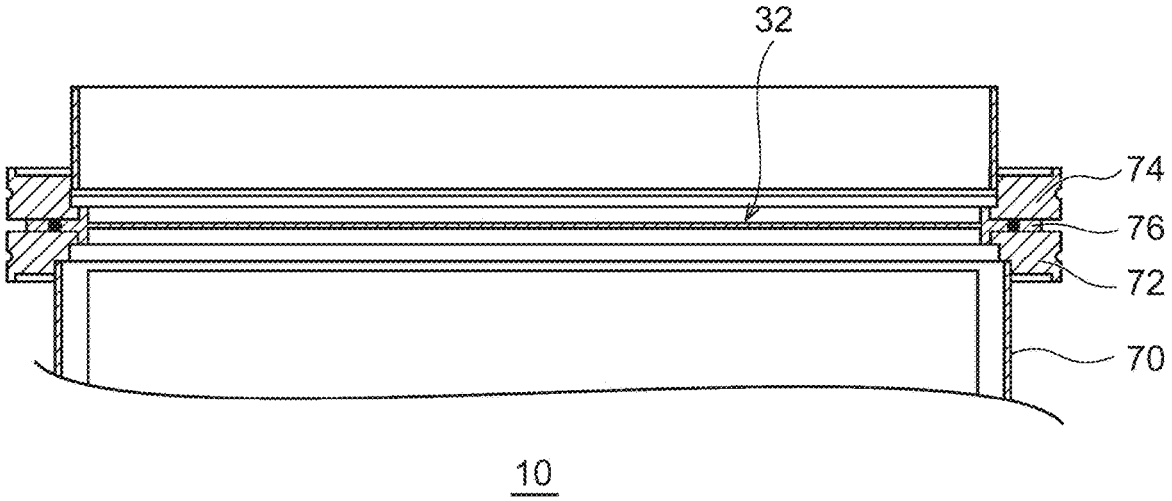
FIG. 7 is a partial sectional view schematically showing a portion of the cryopump shown in FIG. 6.

FIG. 6 is a schematic perspective view of a cryopump 10 according to still yet another embodiment. FIG. 7 is a partial sectional view schematically showing a portion of the cryopump shown in FIG. 6. FIG. 7 shows a part of the cross section of the cryopump 10 in a plane which includes the central axis of the cryopump, as in FIG. 1, and shows the heat shielding dummy panel 32 disposed at the intake port 12 and members around it.

In the embodiment shown in FIGS. 6 and 7, the heat shielding dummy panel 32 is mounted to the center ring 76. When the intake port flange 72 is mounted to the mating flange 74, the center ring 76 is sandwiched between the intake port flange 72 and the mating flange 74.

The heat shielding dummy panel 32 is mounted to the intake port flange 72 through the center ring 76 and is thermally coupled to the cryopump housing 70. Even in this way, the heat shielding dummy panel 32 has a dummy panel temperature, for example, room temperature, higher than the shield cooling temperature during the operation of the cryopump 10. Therefore, similar to the embodiments described above, the heat shielding dummy panel 32 can provide a function of protecting the second-stage cryopanel assembly 20 from a radiant heat.

In the embodiments described with reference to FIGS. 4 to 7, the heat shielding dummy panel 32 can be regarded as configuring a part of the cryopump 10. The mating flange 74 to which the heat shielding dummy panel 32 is mounted, or a vacuum device such as a gate valve having the mating flange 74, or the center ring 76 may be provided to a user by a cryopump manufacturer as an accessory of the cryopump 10.

Even in the embodiment in which the heat shielding dummy panel 32 is thermally coupled to the cryopump housing 70, the emissivity of the dummy panel outer surface may be higher than the emissivity of the dummy panel inner surface.

The present invention has been described above based on the examples. It will be understood by those skilled in the art that the present invention is not limited to the embodiments described above, various design changes can be made, various modification examples can be made, and such modification examples are also within the scope of the present invention.

In the embodiments described above, the dummy panel temperature is maintained so as to exceed 0° C. during the operation of the cryopump 10, so that the heat shielding dummy panel 32 does not provide the pumping capacity for the type 1 gas. However, in a certain embodiment, the heat shielding dummy panel 32 may be cooled to a dummy panel temperature that is higher than the shield cooling temperature and lower than the condensation temperature of the type 1 gas (for example, water vapor). In this way, the heat shielding dummy panel 32 may have a certain degree of pumping capacity for the type 1 gas, although it is not so much as a first-stage cryopanel which is disposed at an intake port in a cryopump of the related art.

In the embodiments described above, the heat shielding dummy panel 32 is formed in a disk shape from a single plate. However, the heat shielding dummy panel 32 may have other shapes. For example, the heat shielding dummy panel 32 may be, for example, a plate having a rectangular shape or other shapes. Alternatively, the heat shielding dummy panel 32 may be a louver or a chevron formed in a concentric circle shape or a grid shape.

In the above description, the horizontal cryopump has been exemplified. However, the present invention is also applicable to other vertical cryopumps. The vertical cryopump refers to a cryopump in which the cryocooler 16 is disposed along the central axis C of the cryopump 10. Further, the internal configuration of the cryopump, such as the arrangement, the shape, the number, or the like of a cryopanel, is not limited to the specific embodiment described above. Various known configurations can be appropriately adopted.

The present invention can be used in the field of cryopumps.

It should be understood that the invention is not limited to the above-described embodiment, but may be modified into various forms on the basis of the spirit of the invention. Additionally, the modifications are included in the scope of the invention.

What is claimed is:

1. A cryopump comprising:

a cryopump housing including a cryopump intake port;

a radiation shield that is disposed inside the cryopump housing in a non-contact manner with the cryopump housing and is cooled to a shield cooling temperature;

a thermal resistance member formed of a material having a thermal conductivity lower than that of a material of the radiation shield, or a heat insulating material; and a heat shielding dummy panel that is disposed at the cryopump intake port and mounted to the radiation shield through the thermal resistance member such that a dummy panel temperature becomes higher than the shield cooling temperature.

2. The cryopump according to claim 1, wherein the material of the thermal resistance member is a synthetic resin material or stainless steel.

3. The cryopump according to claim 1, wherein the heat shielding dummy panel includes a dummy panel outer surface directed outward of the cryopump, and a dummy panel inner surface directed inward of the cryopump, and an emissivity of the dummy panel outer surface is higher than an emissivity of the dummy panel inner surface.

4. The cryopump according to claim 3, wherein the dummy panel outer surface is black colored, and the dummy panel inner surface is a mirrored surface.

5. The cryopump according to claim 1, wherein the heat shielding dummy panel is mounted to the radiation shield through the thermal resistance member such that the dummy panel temperature exceeds 0° C.

6. The cryopump according to claim 1, wherein the heat shielding dummy panel is formed of a material different from a material of the radiation shield.

7. The cryopump according to claim 6, wherein the heat shielding dummy panel is formed of a material having a lower thermal conductivity than the material of the radiation shield.

8. The cryopump according to claim 1, further comprising:

a top cryopanel that is cooled to a lower temperature than the radiation shield, wherein the top cryopanel is located directly below the heat shielding dummy panel and directly faces the heat shielding dummy panel.

9. The cryopump according to claim 1, further comprising:

a cryopanel assembly that is cooled to a lower temperature than the radiation shield and includes a plurality of cryopanels and a plurality of heat transfer bodies axially arranged to form a columnar shape, wherein the plurality of cryopanels and the plurality of heat transfer bodies are axially stacked, wherein the heat shielding dummy panel is disposed axially above the cryopanel assembly.

10. The cryopump according to claim 1, wherein the heat shielding dummy panel is disposed at the cryopump intake port in non-contact with the radiation shield.

11. The cryopump according to claim 1, wherein the thermal resistance member structurally connects the heat shielding dummy panel to the radiation shield.

12. A cryopump comprising:

a cryopump housing including a cryopump intake port;

a radiation shield that is disposed inside the cryopump housing in a non-contact manner with the cryopump housing and is cooled to a shield cooling temperature; and a heat shielding dummy panel that is disposed at the cryopump intake port and thermally coupled to the cryopump housing such that a dummy panel temperature becomes higher than the shield cooling temperature.

13. The cryopump according to claim 12, wherein the cryopump housing includes an intake port flange that defines the cryopump intake port, and the heat shielding dummy panel is mounted to the intake port flange, a mating flange to which the intake port flange is mounted, or a center ring which is sandwiched between the intake port flange and the mating flange.

14. The cryopump according to claim 12, wherein the heat shielding dummy panel is disposed axially above a front end of the radiation shield.

15. The cryopump according to claim 12, wherein the heat shielding dummy panel is disposed at a substantially same axial height as a front end of the radiation shield.

16. The cryopump according to claim 12, wherein the heat shielding dummy panel is disposed at the cryopump intake port in non-contact with the radiation shield.

* * * * *